US010544592B2

(12) United States Patent
Florenske et al.

(10) Patent No.: US 10,544,592 B2
(45) Date of Patent: Jan. 28, 2020

(54) METHOD AND DEVICE FOR PRODUCING COATED, AND IN PARTICULAR PAINTED, BUILDING BOARDS AND ASSOCIATED PAINTED BUILDING BOARD

(71) Applicant: Knauf Gips KG, Iphofen (DE)

(72) Inventors: Oliver Florenske, Möhnesee (DE); Sebastian Mittnacht, Würzburg (DE)

(73) Assignee: KNAUF GIPS KG, Iphofen (DE)

( * ) Notice: Subject to any disclaimer, the term of this patent is extended or adjusted under 35 U.S.C. 154(b) by 811 days.

(21) Appl. No.: 14/909,818

(22) PCT Filed: Jul. 9, 2014

(86) PCT No.: PCT/EP2014/064773
§ 371 (c)(1),
(2) Date: Feb. 3, 2016

(87) PCT Pub. No.: WO2015/018592
PCT Pub. Date: Feb. 12, 2015

(65) Prior Publication Data

US 2016/0186440 A1 Jun. 30, 2016

(30) Foreign Application Priority Data

Aug. 7, 2013 (DE) ..... 10 2013 108 498

(51) Int. Cl.
*B05D 1/28* (2006.01)
*E04F 13/07* (2006.01)
(Continued)

(52) U.S. Cl.
CPC ..... *E04F 13/07* (2013.01); *B05C 1/025* (2013.01); *B05C 1/0808* (2013.01); *B05D 1/28* (2013.01);
(Continued)

(58) Field of Classification Search
USPC ..... 427/428.01
See application file for complete search history.

(56) References Cited

U.S. PATENT DOCUMENTS 3,219,473 A * 11/1965 Dimond ..... B05D 7/08 118/106
4,403,384 A 9/1983 Fogle
(Continued)

FOREIGN PATENT DOCUMENTS

DE 2314531 A1 10/1974
DE 3214655 A1 12/1982
(Continued)

OTHER PUBLICATIONS

Webcapture of the engineering toolbox available on Jul. 17, 2012 as verified by Internet archive wayback machine: https://web.archive.org/web/20120717090528/https://www.engineeringtoolbox.com/young-modulus-d_417.html (Year: 2012).*
(Continued)

*Primary Examiner* — Nathan H Empie
(74) *Attorney, Agent, or Firm* — Mark Terry

(57) ABSTRACT

The subject matter of the present invention is a method for producing coated, and in particular painted, building boards (1), preferably for the interior finishing of buildings. First, the respective building board (1) is provided on its longitudinal edges (2) and/or transverse edges with a bevel (4). Then, the respective building board (1) is transferred to a rubber-like transporting belt (7) in such a way that the edges (2) respectively provided with the bevels (4) are arranged transversely in relation to the conveying direction (F) of the transporting belt (7) and the bevels (4) are arranged adjacent to a visible side (6) of the building board (1), facing away from the transporting belt (7). Finally, a coating material, and in particular paint (13), is applied to the visible side (6) of the building board (1) and respective bevel areas (5) of the
(Continued)

Figure 1:
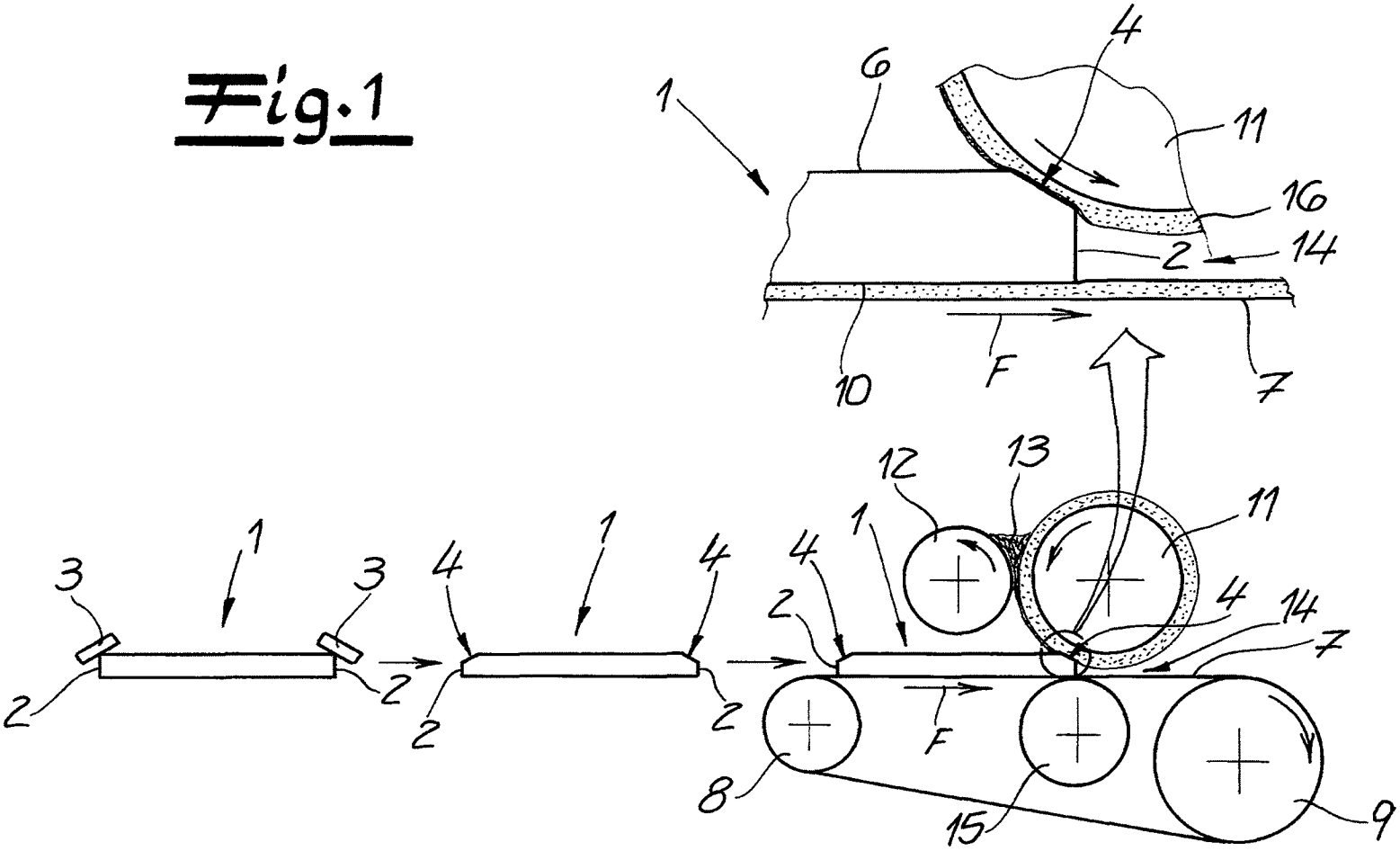

bevels (4) in one operation with the aid of at least one roller (11) arranged above the transporting belt (7) and rotating substantially transversely in relation to the conveying direction (F).

9 Claims, 2 Drawing Sheets

(51) Int. Cl.

| | |
|---|---|
| ***B05C 1/02*** | (2006.01) |
| ***B28B 11/04*** | (2006.01) |
| ***E04C 2/04*** | (2006.01) |
| ***B05C 1/08*** | (2006.01) |

(52) U.S. Cl.
CPC ..... *B28B 11/044* (2013.01); *B28B 11/046* (2013.01); *E04C 2/043* (2013.01)

(56) References Cited

U.S. PATENT DOCUMENTS

| | | | | |
|---|---|---|---|---|
| 2003/0211305 | A1 | 11/2003 | Koval et al. | |
| 2007/0022694 | A1* | 2/2007 | Chen | E04F 13/18 52/578 |
| 2008/0075913 | A1 | 3/2008 | Frenkil | |
| 2014/0017452 | A1* | 1/2014 | Pervan | E04F 15/043 428/172 |

FOREIGN PATENT DOCUMENTS

| | | | |
|---|---|---|---|
| DE | 29915401 | U1 | 11/1999 |
| EP | 1080790 | A2 | 3/2001 |
| EP | 2022568 | A2 | 2/2009 |
| EP | 2423403 | A2 | 2/2012 |

OTHER PUBLICATIONS

PCT International Search Report for Intl. App. No. PCT/EP2014/064773 dated Oct. 10, 2014, from which the instant application is based, 3 pgs.

* cited by examiner

METHOD AND DEVICE FOR PRODUCING COATED, AND IN PARTICULAR PAINTED, BUILDING BOARDS AND ASSOCIATED PAINTED BUILDING BOARD

RELATED APPLICATIONS

This application is a 35 U.S.C. 371 national stage filing from International Application No. PCT/EP2014/064773, filed Jul. 9, 2014, which claims priority to German Application No. 10 2013 108 498.2, filed Aug. 7, 2013, the teachings of which are incorporated herein by reference.

The invention relates to a method for producing coated and in particular painted building boards, preferably for use for the interior finishing of buildings.

Such building boards are generally used for so-called dry construction. This means that the building boards are used for cladding ceilings, walls and in individual cases also floors. Moreover, dry walls can be produced therewith. In the above sense, building board usually means a gypsum fibreboard and in particular a plasterboard. In principle, the building board can however also be a fibre cement board, a timber material board or even a plastic sheet. Moreover, building boards comprising different layers or layer materials are included.

For interior finishing and in particular dry construction with the aid of such building boards, printed surfaces and in particular painted surfaces are increasingly required on the respective visible side of the building board, i.e. the room side. As is known, the paint applied on the visible side is a liquid or powdery coating material. This coating material or paint is applied thin on the visible side of the building board and is built up by chemical and physical processes to form a solid film.

The paint performs essentially two tasks in the case of paints for building boards, in particular for interior finishing. In the first place, the paint is used for decoration, because the building boards often have a surface colour (typically grey) that is scarcely suitable. In addition, there is a protective effect of the paint or the coating produced with the paint against any damage. In principle, the paint can also adjust specific surface properties of the building board, for example change its electrical conductivity in a targeted manner. As a rule, however, it is primarily a matter of providing the building board in question with a specific optical finish.

A printed plasterboard for use in interior finishing is described in the prior art according to EP 2 423 403 A2. A multi-coloured print is applied by means of a multi-coloured ink on the visible side of the plasterboard. Moreover, the known plasterboards are provided with an edge region which can comprise a bevel. The multi-coloured print carried out at this point with the aid of UV ink, which is subsequently cured with UV light, is costly and time-consuming.

For this reason, roller application processes are often used in practice, i.e. procedures with the aid of which paint is applied on building boards by rollers. Use can be made here for example of devices such as are described in DE 299 15 401 U1. The known device is primarily used for flat workpieces, which have an offset at their underside and in particular at transversely running edges. It typically concerns items of furniture here.

If building boards, especially for interior finishing or for producing dry walls, are to be provided for example with the paint coat, the problem arises with the previous procedures that, when paint is applied for example with a device according to DE 299 15 401 U1, the edge regions and the bevels provided there are not reached by the paint. This necessitates upstream or downstream processing steps. As an alternative to this, work is also carried out in practice with adhesive edge strips. This is all relatively expensive, because additional production and processing steps are required. The invention aims to provide a general remedy here.

The technical problem underlying the invention is to develop such a method further in such a way that a coating of the building board on its visible side is also enabled in a quick, problem-free and cost-effective manner in the edge region with a bevel provided there.

To solve this technical problem, the subject-matter of the invention is a method for producing coated and in particular painted building boards, preferably for the interior finishing in buildings, with the following process steps:

- the respective building board is provided on its longitudinal edges and/or transverse edges with a bevel;
- the respective building board is transferred onto a rubber-like conveyor belt in such a way that the edges respectively provided with the bevels are arranged transversely in relation to the conveying direction of the conveyor belt and the bevels are arranged adjacent to a visible side of the building board and facing away from the conveyor belt;
- a coating material and in particular a paint is applied to the visible side of the building board and at the same time to the respective bevel areas of the bevels in one operation with the aid of at least one roller arranged above the conveyor belt and rotating essentially transversely in relation to the conveying direction.

The building board is advantageously a plasterboard, although other building boards are also covered by the invention, for example the variants described in the introduction. Such plasterboards are typically produced in such a way that the cardboard forming the visible side of the plasterboard is drawn off from a roll supply. The cardboard is then formed into a flat rectangular tank accommodating the gypsum slurry.

Any turned-up edges of the cardboard are pushed down to the free surface of the gypsum slurry in the so-called calibration of the plasterboard. Finally, a rear-side cardboard is applied. After the start of the setting process of the gypsum slurry, the board strand thus formed is cut to specific lengths and/or widths.

Modern production lines for plasterboards usually produce the building boards in question in such a way that the board strand has a width which corresponds to the length required for the processing of the plasterboards. As soon as the board strand is cut in the transverse direction, therefore, the desired building board is available with the correspondingly cut longitudinal edges. Due to the cut edge, there is no cardboard present at the longitudinal edges, so that an edge protection profile is usually applied here in practice. According to the invention, however, such an edge protection profile is dispensed with, but on the contrary the edges in question are tapered, i.e. receive a bevel.

Since the plasterboards in question are fixed edge to edge on a frame or framework, for example in the production of dry walls, step changes in the evenness and/or possibly material thickness from one plasterboard to the following plasterboard are observed in plan view in the abutting region in the absence of post-processing. This is visually disturbing and is not accepted by the market. For this reason, work is carried out in practice with, for example, rounded rebates on the longitudinal edges, in order to level out the abutting region with filler and to provide a smooth transition.

Within the scope of the invention, such an expensive post-processing step on the cut edges is not (no longer) required. This is because the cut edges in question—as already described—are tapered or provided with the already mentioned bevel. According to an advantageous embodiment, the building boards are in fact provided with the bevels at both their longitudinal edges, and more precisely observing in each case a bevel angle between 20° and 40°, preferably between 30° and 35°. The bevel angle generally denotes the angle of an associated bevel or bevel area at the edge in question that is enclosed with a horizontal or more precisely the visible side.

In addition, it has proved beneficial if the bevel is provided with a flat level area or at any rate a bevel area curved slightly outwards in a convex manner. Moreover, the rotating roller for applying the coating material or the paint on the building board is advantageously provided with a flexible surface and for example a rubber coating.

The possibility thus exists for the rotating roller in question on the one hand and the rubber-like conveyor belt on the other hand to have comparable elasticities. In this connection, the layout is usually selected such that the roller in question and the conveyor belt lie opposite one another, wherein the building board to be coated is passed through the gap between the roller and the conveyor belt. A counter-roller can also be provided beneath the conveyor belt in this region to support the conveyor belt.

In any case, the comparable elasticities of, on the one hand, the rotating roller for the application of the coating material and, on the other hand, of the rubber-like conveyor belt ensure that the building board passing as it were transversely through the gap with its bevels orientated transversely to the conveying direction is coated, and also can be coated in one operation, on the visible side and at the longitudinal edges. This takes place by means of the special roller application process. The respective flexibility between the roller or application roller on the one hand, i.e. its rubber coating, and the rubber-like conveyor belt on the other hand enables an all-over coating of the respective bevel areas of the longitudinal edges as well as of the visible side of the building board located in between, and in one operation.

The building board can thus be provided with the desired coating in a particularly cost-effective manner, said coating being for example a paint or paint application. It can in principle be any kind of paint, i.e. those which are cured by evaporation of solvents or also those which are irradiated with UV light for the curing.

The rubber coating of the rotating roller for the application of the paint and the rubber-like conveyor belt have—as already described—comparable elasticities. A respective modulus of elasticity in the range from 0.01 to $0.1 \cdot 10^9$ N/m$^2$ has proved to be beneficial here. The conveyor belt on the one hand and the rotating roller for the application of the coating material on the other hand thus yield and can assume the shape both of the bevel area in the region of the bevel and also of the visible side between the two bevels, so that the all-over application of the coating material is successfully carried out in one operation.

The subject-matter of the invention is also a device, which is particularly suitable for producing coated building boards and is recommended for performing the described method. The device in question is provided with at least one planing unit for providing the respective building board with the bevel at its longitudinal edges and/or transverse edges. Furthermore, the device comprises the rubber-like conveyor belt and the roller disposed above the conveyor belt with the further specifications.

Finally, the subject-matter of the invention is a painted building board, which is provided in each case with a bevel at its longitudinal edges and/or transverse edges. The respective bevel area associated with the bevel and the visible side of the building board have a coating applied in one operation. Moreover, the building board is characterised in that a bevel area is disposed above a base area in the thickness direction. This means that the bevel area follows on from the base area in the direction of the visible side of the building board. Overall, the design is made in such a way that the bevel area has a thickness or material thickness which amounts to less than half the thickness or material thickness of the base area.

It is thus ensured that the elasticities of, on the one hand, the roller for the application of the coating material and, on the other hand, of the rubber-like conveyor belt are overall sufficient to be able reliably to accommodate between them and hold and convey the building board both in the visible region and also in the region of its two longitudinal edges with the bevels and at the same time to ensure the coating in the region of the bevel areas and the visible side located in between.

As a result, a method and an associated device for producing coated and in particular painted building boards are described, which enable a particularly cost-effective application of coating material on the building board in question. As a result of this, the coated building board also belonging to the protected subject-matter can be offered at a favourable cost. Nonetheless, the building board has a flawless decorative finish both on its visible side and also in the region of the bevel areas on the longitudinal edges. The building board according to the invention is thus suitable for direct processing in the production of dry walls.

In this connection, the individual building boards are in fact fixed to the frame with the longitudinal edges of edge to edge. As a result of the bevels in the abutting region, any unevennesses or step changes in plan view are practicably not (no longer) observed. Since, moreover, the respective bevel area together with the visible side has a uniform coating, a flawless all-over wall decoration can be made available, and more precisely without post-processing. The main advantages are to be seen in this.

Figure 2:
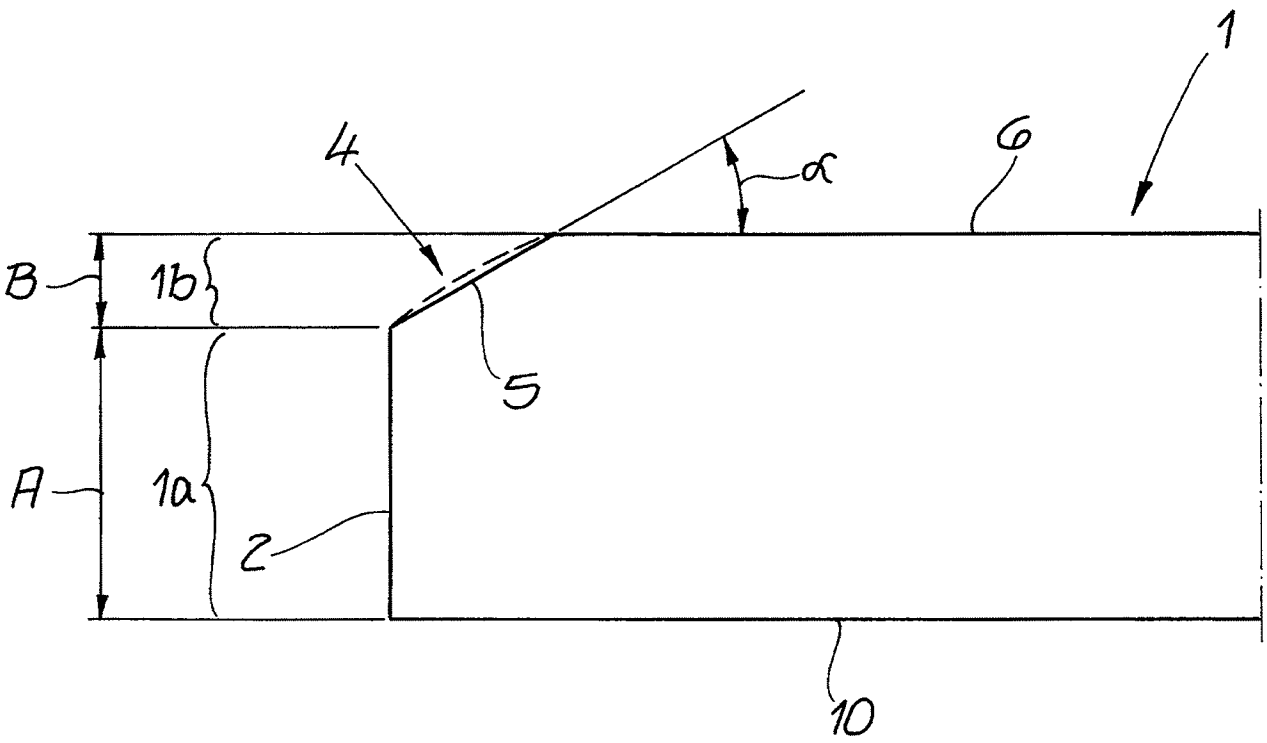

The invention is explained in greater detail below with the aid of a drawing merely representing an example of embodiment; in the figures:

FIG. 1 shows the device according to the invention for producing coated building boards and FIG. 2 shows the building board produced according to the described method in the edge region in cross-section.

A device for producing coated and in particular painted building boards 1 is represented in the figures. Building boards 1 in the present case are plasterboards 1, which have been produced from a board strand. For this purpose, the board strand has been cut in the transverse direction to the representation of respective longitudinal edges 2 of building board 1. No cardboard is consequently present in the region of longitudinal edges 2 on account of the cut edge there. Since building boards 1 are arranged edge to edge with their longitudinal edges 2, for example in the production of a drywall, the abutting region has to be processed in order to provide a flawless transition.

For this purpose, the device is provided with at least one planing unit 3. As can be seen from the representation according to FIG. 1, two planing units 3 lying opposite one another and assigned to respective longitudinal edge 2 are in fact provided, said planing units being designed and equipped for providing respective building board 1 with a bevel 4 at its longitudinal edges 2.

Bevel 4 is as usual an inclined surface at the edge of a workpiece, in the present case at longitudinal edge 2 of building board or plasterboard 1. With the aid of the two planing units 3 lying opposite one another, building board is thus tapered at its cut edges defining respective longitudinal edges 2. Bevel area 5 running along the bevel and longitudinal edge 2 thus arises.

It can be seen that, within the context of the example of embodiment, and particularly preferably, bevel 4 is provided with a respective bevel angle $\alpha$ between approx. 20° and approx. 40°. Bevel angle $\alpha$ is designed equal at both longitudinal edges 2. As usual, bevel angle $\alpha$ is enclosed between bevel area 5 and a horizontal.

In the example of embodiment, and as can be seen in FIG. 2, the horizontal is a visible side 6 or a plane of building board or plasterboard 1 parallel thereto. Bevel area 5 is constituted flat overall. In principle, bevel area 5 can however also have a shape curved (slightly) outwards in a convex manner in the represented cross-section according to FIG. 2, as is indicated by the dashed line in FIG. 2. According to a particularly preferred embodiment of the invention, bevel angle $\alpha$ is located between 30° and 35°.

After respective longitudinal edges 2 of building board or plasterboard 1 have been tapered as described with the aid of the at least one or the two planing units 3, building board 1 is transferred onto a conveyor belt 7 or placed onto respective conveyor belt 7. Respective building board 1 is in fact transferred onto rubber-like conveyor belt 7 in such a way that the edges each provided with bevels 4 and in particular longitudinal edges 2 are arranged, according to the example of embodiment, transversely in relation to conveying direction F of conveyor belt 7. Moreover, the design is made such that building board 1 with its bevels 4 at visible side 6 or adjacent to visible side 6 of building board 1 are arranged facing away from conveyor belt 7. In the example of embodiment, the two bevels 4 of building board 1 running adjacent to visible side 6 each point upwards. In contrast, rear side 10 of building board 1 lies on conveyor belt 7.

It can be seen that conveyor belt 7 is tensioned by two deflection rollers 8, 9 and is driven with the aid of deflection rollers 8, 9. As a result of this, building board or plasterboard 1 is transported in conveying direction F. At least one roller 11, which is arranged above conveyor belt 7, belongs to the further basic structure. In the example of embodiment, two rollers 11, 12 are in fact provided, which in the present case are constituted as application roller 11 and metering roller 12 upstream thereof and have an arrangement above conveyor belt 7. The two rollers 11, 12 form an upper gusset-like space filled with paint 13. A narrow gap between the two rollers 11, 12 ensures that paint 13 passes in the desired quantity onto paint application roller 11 and from there onto building board 1.

Roller or application roller 11 rotates just like metering roller 12 in each case about an axis orientated essentially transversely in relation to conveying direction F, as corresponding arrows in FIG. 1 indicate. Moreover, the design is made in such a way that roller or application roller 11 and conveyor belt 7 together define between them a gap 14, through which building board of plasterboard 1 is passed for the purpose of coating. In the example of embodiment represented, a counter-roller 15 is also provided opposite application roller 11 and beneath conveyor belt 7, with the aid of which counter-roller conveyor belt 7 together with building board 1 conveyed through gap 14 is supported against the contact pressure on the part of the application roller 11.

In the example of embodiment, with the aid of roller or application roller 11 arranged above conveyor belt 7 and rotating essentially transversely in relation to conveying direction F, paint 13 is applied in gap 14 not only on visible side 6 of building board 1, but also on respective bevel areas 5 of bevels 4 at longitudinal edges 2, and indeed in one operation. As a result of this, building board 1 thus provided with the respective coating has, after passing through gap 14, a paint coat or generally the coating applied in one operation on respective bevel 4 or its bevel area 5 and visible side 6.

In order to enable this in detail, rotating roller or application roller 11 for the application of paint 13 is provided with a flexible surface 16 indicated in FIG. 1. This flexible surface 16 is a rubber coating of roller or application roller 11 in question. Conveyor belt 7, for its part, is constituted rubber-like. It has proved generally to be beneficial if rotating roller or application roller 11 on the one hand and conveyor belt 7 on the other hand have comparable elasticities. In the example of embodiment, the respective modulus of elasticity of rubber coating 16 as well as that of the material of conveyor belt 7 is located in the range from 0.01 to $0.01 \cdot 10^9$ N/m$^2$. This applies of course only by way of example and is in general not imperative.

It can be seen on the basis of FIG. 2 that building board 1 is provided in the thickness direction with a base area 1*a* and a bevel area 1*b* arranged above base area 1*a*. Base area 1*a* has a material thickness or thickness A. Bevel area 1*b* is provided with a material thickness or thickness B.

The design is made overall in such a way that thickness B of bevel area 1*b* is less than half compared to thickness A of base area 1*a*. That is to say that the following applies:

$$B \leq 0.5\ A.$$

Usually, even the relationship $B \leq 0.4$ is met.

It is thus ensured that bevel 4 of building board 1 extends only over a thickness region of building board 1 which amounts to 50% and less, in particular even 40% and less, of the thickness. The "step" associated with this can consequently be accommodated and compensated for without problem during the passage of building board 1 through gap 14 by, on the one hand, rubber coating 16 of roller or application roller 11 and, on the other hand, rubber-like conveyor belt 7. As a consequence of this, building board 1 is coated in one operation with paint 13 during the passage through gap 14 with the aid of rotating roller or application roller 11 both on visible side 6 and also in the region of its respective bevel areas 5 of bevels 4 at respective longitudinal edges 2. Any post-processing of bevel areas 5 is therefore not (no longer) necessary.

In addition, there is the fact that respectively tapered longitudinal edges 2, when they are joined edge to edge to form a drywall for example, convey an optically uniform overall impression without any step changes or unevennesses. This is because the two bevels 4 or their bevel areas 5 accommodate visible side 6 located in between. Bevels 4 and visible side 6 have all been coated together and in one operation and have a coating of paint 13 applied in one operation. The main advantages are to be seen in this.

The invention claimed is:

1. A method for producing coated building boards for the interior finishing of buildings, with the following process steps:

1.1) the respective building board is provided on its longitudinal edges and/or transverse edges with a bevel;

1.2) the respective building board is transferred onto a rubber-like conveyor belt having a certain elasticity such that when pressed against the respective building board, a surface of the conveyor belt assumes a shape of the respective building board against which the surface of the conveyor belt is pressed, in such a way that the edges respectively provided with the bevels of the respective building board are arranged transversely in relation to the conveying direction of the conveyor belt and the bevels are arranged adjacent to a visible side of the building board and facing away from the conveyor belt;

1.3) a coating material is applied to the visible side of the building board and respective bevel areas of the bevels in one operation with the aid of at least one roller having an elasticity substantially equal to the elasticity of the conveyor belt, such that when pressed against the building board, a surface of the at least one roller assumes a shape of the bevels against which the at least one roller is pressed, wherein the at least one roller is arranged above the conveyor belt and rotating essentially transversely in relation to the conveying direction.

2. The method according to claim 1, characterised in that the building board is provided with the bevels at both its longitudinal edges in each case observing a bevel angle between 20° and 40°.

3. The method according to claim 1 or 2, characterised in that the bevel area of the bevel is constituted flat or curved slightly outwards in a convex manner in cross-section.

4. The method according to any one of claim 1 or 2, characterised in that the rotating roller for applying the coating is provided with a flexible surface.

5. The method according to claim 2, wherein the bevel angle is between 30° and 35°.

6. The method according to claim 4, characterised in that the rotating roller on the one hand and the conveyor belt on the other hand have elasticities in the range of 0.01 to $0.1\times10^9$ N/m$^2$.

7. The method according to claim 4, characterised in that the bevel area of the bevel is constituted flat or curved slightly outwards in a convex manner in cross-section.

8. The method according to claim 4, wherein the rotating roller for applying the coating is provided with a rubber coating.

9. The method according to claim 1, wherein the coating material comprises paint.

* * * * *